United States Patent [19]

Hoshino

[11] Patent Number: 4,581,973

[45] Date of Patent: Apr. 15, 1986

[54] PAD WITH DRUMHEAD FOR ELECTRONIC DRUM

[75] Inventor: Yoshiki Hoshino, Owariasahi, Japan

[73] Assignee: Hoshino Gakki Co., Ltd., Japan

[21] Appl. No.: 665,779

[22] Filed: Oct. 29, 1984

[30] Foreign Application Priority Data

Mar. 31, 1984 [JP] Japan ..... 59-047784[U]

[51] Int. Cl.[4] ..... G10D 13/02; G10H 3/12

[52] U.S. Cl. ..... 84/1.14; 84/411 P; 84/DIG. 12; 84/465

[58] Field of Search ..... 84/1.04, 1.06, 1.14–1.16, 84/411 R, 411 P, 465, DIG. 12

[56] References Cited

U.S. PATENT DOCUMENTS 3,264,926 8/1966 Belli .
3,509,264 4/1970 Green .
3,597,520 8/1971 Andrews .
3,956,959 5/1976 Ebihara et al. ..... 84/DIG. 12
4,279,188 7/1981 Scott .
4,479,412 10/1984 Klynas ..... 84/DIG. 12

*Primary Examiner*—Stanley J. Witkowski
*Attorney, Agent, or Firm*—Ostrolenk, Faber, Gerb & Soffen

[57] ABSTRACT

A pad for an electronic drum has a vibration responsive plate that is mounted on a cushion and has on its upper surface a relatively thin buffer pad, the plate having cushioning means on its outer edge between it and peripheral supporting structure, and a drumhead stretched directly over the buffer pad and retained by a cover member held in spaced relation from the plate, so that the feel of the pad is quite natural to the player and that vibrations from the frame or supporting structure are insulated from the plate, and that the plate vibrations are not adversely affected, the plate carrying a microphone or other sound pick-up means.

5 Claims, 3 Drawing Figures

PAD WITH DRUMHEAD FOR ELECTRONIC DRUM

BACKGROUND OF THE INVENTION

1. Field of the Invention

This invention relates to musical instruments, more particularly those of the percussive type in which the sound is picked up by a microphone mounted on the instrument, itself. It further relates to a drum pad in which the conventional head may be omitted, but in which the construction and arrangement of the elements is such as to simulate the natural feel of a conventional head.

2. Description of the Prior Art

Drum practice pads which include relatively rigid support structure and cushion members thereover have been provided in the past as for example in the U.S. Pat. No. 3,264,926, to Bell and U.S. Pat. No. 3,597,520 to Andrews. However, these were intended merely for practice purposes rather than for performance and do not disclose any means for amplification.

The U.S. Pat. No. 3,509,264 to Green discloses what appears to be a conventional drumhead having a sound amplifier connected thereto. The U.S. Pat. No. 4,279,188 to Scott discloses a practice pad in which an electromechanical transducer is substantially contiguous with the drumhead, and in which a speaker cone type pick-up is installed on the base of the body in order to pick-up the vibrations generated by hitting the drumhead.

SUMMARY OF THE INVENTION

A drum pad in accordance with the present invention has a relatively rigid plate member which is responsive to the vibrations received from being struck by the instruments used by the player of the drum, in which the plate is mounted on an appropriately supported cushion member and has an overlying buffer pad and adjustable drumhead, the plate being mounted so that it is spaced away from a side retaining wall by a cushioning element thereby insulating the plate from vibrations that otherwise may be transmitted from the supporting structure and at the same time providing a pad that has a natural feel for the player.

DESCRIPTION OF THE PREFERRED EMBODIMENT

With further reference to the drawings there is illustrated a base 10 which may be mounted in any suitable manner for use by a player. The base has an outer rim portion 11 and an upstanding outer wall 12 adjacent thereto, and an upstanding inner wall 13 which is spaced inwardly thereof. Wall 13 is preferably subtantially circular and is spaced away from the axis of the base 10.

Figure 1:
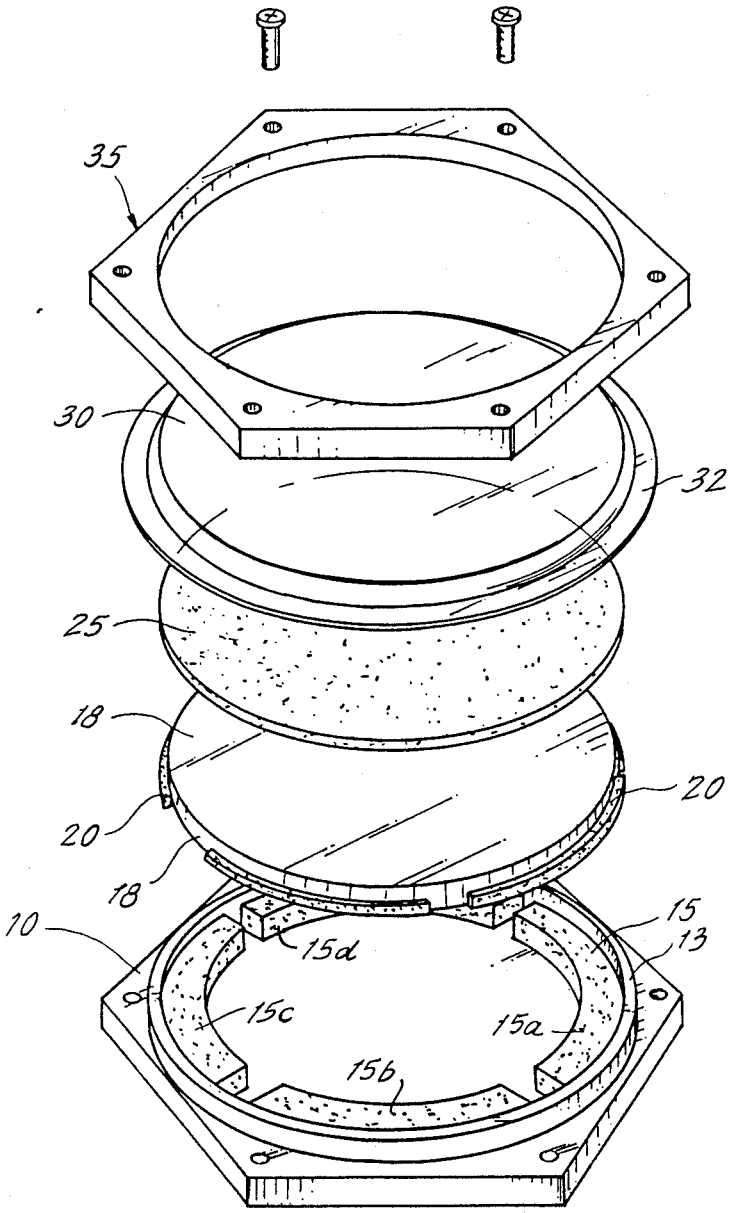
FIG. 1 is an exploded view of a drum pad in accordance with the present invention.

Mounted on the base 10 and just within the inner surface wall 13 is a cushion member 15 of polyurethane foam or the like, of substantial thickness. The cushion member is preferably ring shaped and is preferably of disconnected or spaced segments 15*a* 15*b*, 15*c* and 15*d* as illustrated in FIG. 1. To enhance the cushioning effect, the cushion member 15 supports a plate member 18 which, in the illustrated embodiment, is of circular configuration and of a width or diameter such that its outer rim is spaced from the inner surface of the wall 13.

The plate 18 is substantially rigid and constructed of material, such as a fiber board veneer, that is particularly adapted to respond to the vibrations received from the instruments used by the player, such as drumsticks or brushes or the like.

Mounted in the space between the outer rim of the plate 18 and the upstanding wall 13 is a cushioning element 20 which is preferably affixed to the outer rim of the plate 18, centrally between its upper and lower side edges 1, as illustrated in FIG. 1, and may, if preferred, be of spaced segments instead of being continuous. The thickness of the cushioning 20 is preferably such that a slight space, say one millimeter, is left between its outer surface and the inner surface of the wall 13, for purposes which will be described.

Mounted on the underside of the plate 18 in a recess 18' is a microphone or other sound pick-up device 22 which is connected to an amplifier (not shown) by conventional means.

The top surface of the plate 18 has a relatively soft buffer pad 25, which may be of sponge rubber or the like, and preferably has a thickness of between two and five millimeters. The buffer pad preferably extends past the outer rim of the plate 18 and into abutting engagement with the inner surface of the wall 13.

Disposed over the pad 25 is a drumhead 30 having a central or playing portion 31 and a ring-like rim portion 32 which extends beyond the upstanding wall 13 of the base 10. The drumhead and pad together provide an improved natural feeling for the performer as he strikes the drumhead.

Figure 2:
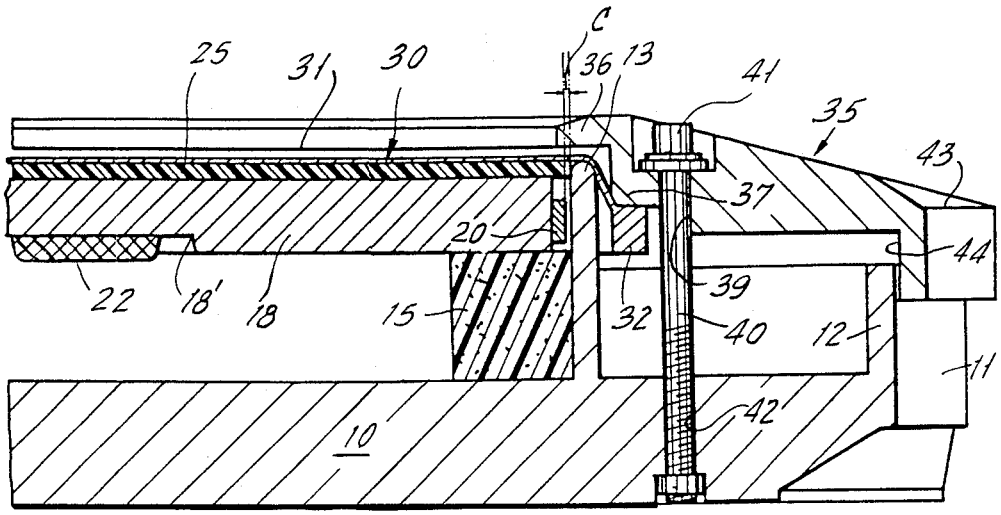
FIG. 2 is a section to an enlarged scale through a portion of the device of FIG. 1 in assembled relationship.

In order to hold the elements in assembled relationship a ring-shaped cover member 35 is provided having a raised inner rim portion 36, mounted in spaced relation from the upper edge of the wall 13, and a lower stepped inner rim portion 37, which is spaced outwardly of rim portion 36 and engages the rim portion 32 of the drumhead 30 (FIG. 2). The cover has an aperture 39 for receiving a bolt 40 secured by nut 41, the bolt also passing through aperture 42 in the base 10.

The cover has an outer rim portion 43 which is in spaced relation from the rim portion 11 of the base portion 10. Rim portion 43 has an inner rim surface portion 44 which engages the outer rim portion 11 of base 10 in order to guide the parts in their adjusting positions.

Accordingly, it can be seen that by adjustment of nut 41 the tightness of the drumhead may be varied to suit the preference of the individual performers.

Figure 3:
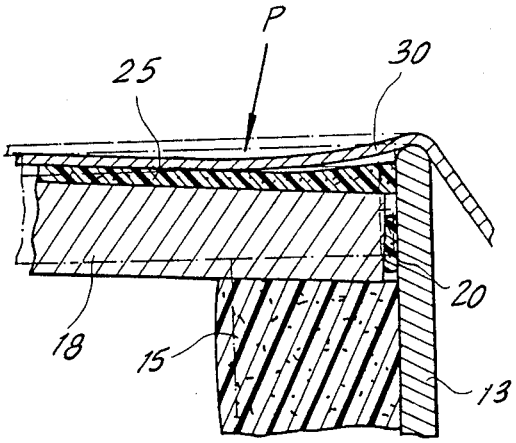
FIG. 3 is a section, to a still larger scale, of the outer edge portion of the plate members and the cushioning elements, illustrating these elements during playing when the plate member is tilted.

As indicated in FIG. 3 when a substantial playing force P is applied to one side of the head surface the plate member may be depressed at one side but the cushioning member 15 still maintains the plate out of engagement with the sidewall 31. Thus, vibrations transmitted from the external support structure and the outer cover are largely avoided. Furthermore, vibrations in the plate are not adversely affected nor transmitted to the rigid support structure due to direct contact with the wall 13 which would occur in the absence of the cushioning 20.

The overall structure makes it possible to produce accurately and with fine shading the player's beating vibrations, at the same time reducing the fatigue of the player, thereby providing improved functional advantages as compared with conventional products.

I claim:

1. A drum pad for mounting on a support comprising a base member having upstanding wall means, first cushion means mounted on the base means and inwardly of said wall means, a relatively hard and rigid plate member mounted on the cushion means, said plate member having an outer peripheral edge spaced inwardly of said wall means, sound pick-up means mounted on said plate member, a relatively soft pad overlying the plate member, second cushion means positioned in the space between said outer peripheral edge of said plate member and said wall means, a drumhead having a rim portion which extends outwardly beyond said wall means, and a cover member, said cover member extending in spaced relation around and above the outer portion of the base member and engaging said rim portion of said drumhead, and fastening means adjustably securing said cover member and said rim portion and said drumhead in assembled relationship.

2. The invention of claim 1, in which said wall means is integral with said base member.

3. The invention of claim 1, in which said first cushion means extends around the peripheral portion of said base member and is open in its center.

4. The invention of claim 3, in which said first cushion means comprises spaced cushion elements.

5. The invention of claim 1, in which said plate member has substantial thickness providing upper and lower side edges, and said second cushion means is mounted on the outer peripheral edge of said plate member substantially midway of said upper and lower side edges.

* * * * *